US006739902B2

(12) United States Patent
Miyazawa et al.

(10) Patent No.: US 6,739,902 B2
(45) Date of Patent: May 25, 2004

(54) FLAT CABLE CONNECTOR WITH IMPROVED ACTUATOR

(75) Inventors: Junichi Miyazawa, Yokohama (JP); Yoshikazu Ito, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/266,803

(22) Filed: Oct. 8, 2002

(65) Prior Publication Data

US 2003/0082946 A1 May 1, 2003

(30) Foreign Application Priority Data

Oct. 15, 2001 (JP) ..... 2001-316226

(51) Int. Cl.[7] ..... H01R 12/24
(52) U.S. Cl. ..... 439/495
(58) Field of Search ..... 439/495, 492

(56) References Cited

U.S. PATENT DOCUMENTS 5,863,217 A * 1/1999 Ii et al. ..... 439/495
6,315,602 B1 * 11/2001 Miura et al. ..... 439/495
6,315,603 B1 * 11/2001 Miura et al. ..... 439/495

FOREIGN PATENT DOCUMENTS

JP 2000223190 A * 8/2000 ..... H01R/12/28

* cited by examiner

*Primary Examiner*—Hae Moon Hyeon
(74) *Attorney, Agent, or Firm*—Stephen Z. Weiss

(57) ABSTRACT

An electrical connector is provided for terminating a flat flexible cable. The connector includes a dielectric housing for receiving the flat flexible cable, the housing having arm holders at opposite ends thereof. A plurality of conductive terminals are mounted on the housing for electrically engaging appropriate conductors of the flat flexible cable. An elongated actuator is movably mounted on the housing and includes a body with a pressing portion for biasing the cable against the contact portions of the terminals. The actuator is fabricated of rigid ceramic material. A pair of connecting arms are mounted at opposite ends of the actuator and are of a resilient material other than ceramic for insertion into the arm holders of the housing.

13 Claims, 5 Drawing Sheets

FLAT CABLE CONNECTOR WITH IMPROVED ACTUATOR

FIELD OF THE INVENTION

This invention generally relates to a flat cable connector for use in connecting the conductors of a flat cable, a flat flexible cable, a flexible printed circuit board or the like.

BACKGROUND OF THE INVENTION

As is known in the art, a flat flexible cable connector generally includes a dielectric housing having a plurality of terminals arranged at regular intervals across a mouth of the housing. The terminals have contact portions for electrically engaging conductors on the flat flexible cable inserted into the mouth. An actuator is slidably mounted on the housing for biasing the flat flexible cable against the contact portions of the terminals. Typically, the actuator is slidably fixed to the housing by a pair of connecting arms at opposite sides of the actuator, with the flat flexible cable being inserted between the arms.

An actuator of the character described must have good strength as it is moved back and forth with respect to the dielectric housing, and as it applies a predetermined pressure to the flat flexible cable to press the cable into engagement with the contact portions of the terminals. The actuator preferably is electrically insulating and is resistive to heat. Preferably, the actuator can be made by a molding process because it typically has a relatively complicated shape. It also is highly desirable that the actuator have a low-profile (thin) because of the ever-increasing demand for miniaturization of these types of electrical connectors.

Molded plastic actuators create problems in trying to meet the requirements described immediately above. For instance, if a molded plastic actuator is sufficiently robust to provide for good strength, the plastic actuator cannot have a thin or low profile. Attempts have been made to provide a metal actuator which is coated with a plastic material or a molded plastic actuator having a metal core embedded therein. Unfortunately, these composite actuators require extra molding steps and additional fabrication equipment and, accordingly, the manufacturing costs are unduly high for such a relatively simple connector.

As disclosed in Japan Patent Application Laid-Open No. 2000-223190, it has been proposed to provide an actuator of ceramic material for pressing the conductors of the cable against the contact portions of the terminals in the connector housing. The ceramic actuator has a flat major section with pivot blocks integrally connected to its rear corners. Each pivot block has grooves in an outer surface thereof. Two counter pivot blocks are integrally connected to the connector housing at such positions that their semi-circular pivot projections may be press-fitted into the grooves of the pivot blocks. The actuator and the dielectric housing are assembled together with the semi-circular pivot projections of the counter pivot blocks fitted in the grooves of the pivot blocks, thereby permitting the actuator to turn and move back and forth with respect to the dielectric housing. The actuator does not have any separate connecting arms to couple the actuator to the dielectric housing. Such connecting arms cannot be fastened to the ceramic actuator by a press-fit because the ceramic material is too hard and fragile and is prone to be broken when a strong force is applied thereto. Connecting arms cannot be insert molded like a plastic inserted molding process, because ceramic articles are produced after being subjected to tentative calcination and final sintering. Connecting arms are difficult and not appropriate to be adhered to the ceramic actuator by various adhesives because such processes are not appropriate for automation. In addition, adhesives lack sufficient strength and durability.

The present invention is directed to solving these problems by providing a flat cable connector with an actuator fabricated of ceramic material, along with connecting arms of resilient material other than ceramic.

SUMMARY OF THE INVENTION

An object, therefore, of the invention is to provide a new and improved electrical connector for terminating a flat flexible cable.

Another object of the invention is to provide a new and improved actuator for use with a flat flexible cable connector.

In the exemplary embodiment of the invention, the connector includes a dielectric housing having an elongated mouth for receiving a terminating end of the flat flexible cable. The housing has arm holders generally at opposite ends of the mouth. A plurality of conductive terminals are mounted on the housing and are spaced along the mouth. The terminals have contact portions for engaging appropriate conductors of the flat flexible cable. An elongated actuator is movably mounted on the housing and includes a body with a pressing portion for biasing the cable against the contact portions of the terminals. The actuator is fabricated of rigid ceramic material. A pair of connecting arms are provided at opposite ends of the actuator and are of a resilient material other than ceramic for insertion into the arm holders of the housing. As disclosed herein, the actuator preferably is fabricated of a zirconia ceramic material. The connecting arms are fabricated of metal material.

According to one aspect of the invention, the actuator includes a passage within which each connecting arm is mounted. Complementary interengaging latch means are provided between the connecting arm and the actuator within the passage to hold the arm therein. Each connecting arm includes a resilient latch head engageable with a latch surface on the actuator in the respective passage. The resilient latch head snaps into engagement with the latch surface automatically in response to insertion into the respective passage, whereby the respective connecting arm cannot be pulled back out of the passage. Complementary interengaging stop means are provided between each connecting arm and the actuator to limit the extent to which the connecting arm can be inserted into the passage.

Another feature of the invention is that each arm holder on the dielectric housing includes a channel for receiving a respective one of the connecting arms. A cover is mountable on the housing to hold the respective connecting arm in its channel.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
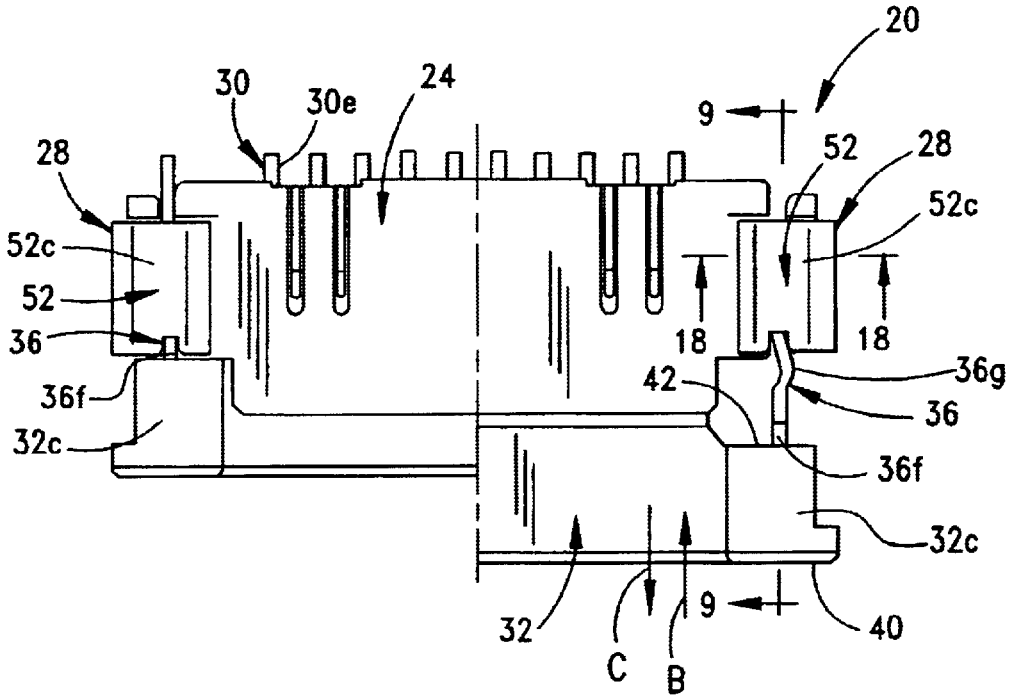
FIG. 1 is a top plan view of a flat flexible cable connector according to the invention, showing the actuator in its open or preload position at the right-half of the drawing and with the actuator in its closed or terminating position in the left-half of the drawing.
Figure 2:
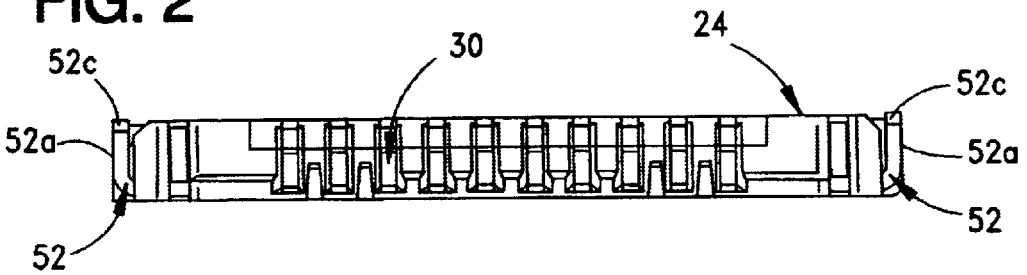
FIG. 2 is a rear elevational view of the connector.
Figure 3:
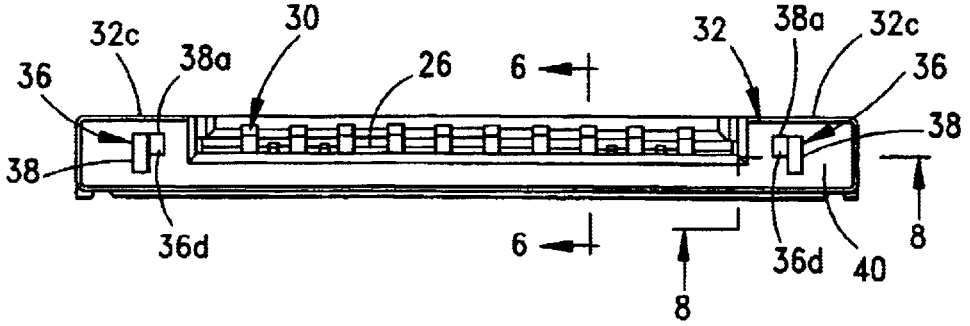
FIG. 3 is a front elevational view of the connector.
Figure 4:
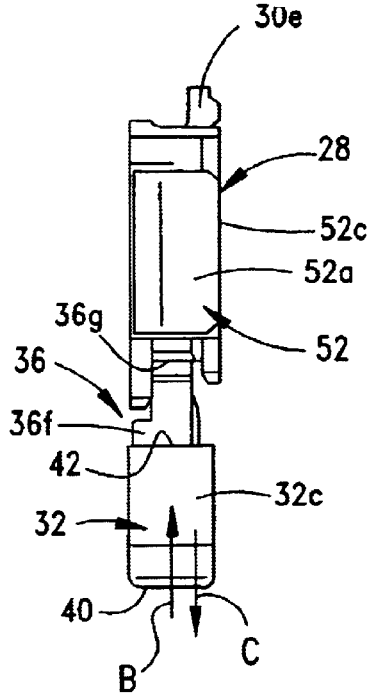
FIG. 4 is a side elevational view of the connector looking at the right-hand side of FIG. 1 with the actuator in its open position.
Figure 5:
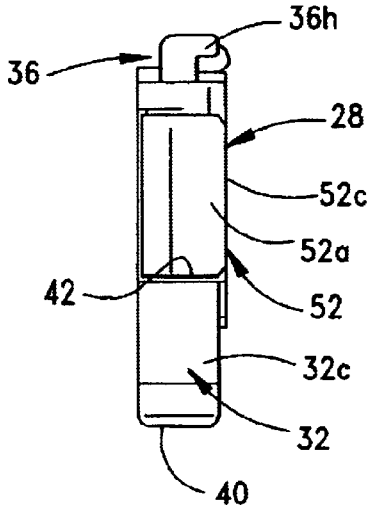
FIG. 5 is a view similar to that of FIG. 4, with the actuator in its closed position.

Referring to the drawings in greater detail, and first to FIGS. 1–7, the invention is embodied in an electrical connector, generally designated 20, for terminating a flat flexible cable 22 (FIGS. 6 and 7) such as a flexible printed circuit board or the like. The connector includes a dielectric housing, generally designated 24, having an elongated mouth 26 (FIGS. 3 and 6) for receiving a terminating end 22*a* of flat flexible cable 22. The housing has arm holders, generally designated 28, at opposite sides thereof at opposite ends of elongated mouth 26. A plurality of conductive terminals, generally designated 30, are mounted in the housing and are arranged at regular intervals longitudinally of mouth 26. The terminals have contact portions 30*a* (FIGS. 6 and 7) for engaging appropriate conductors on the top of flat flexible cable 22 generally at terminating end 22*a* thereof. An elongated actuator, generally designated 32, is movably or slidably mounted on housing 24 and includes a body 32*a* (FIGS. 6 and 7) with a plate-like pressing portion 32*b* for biasing cable 22 and the conductors thereof against contact portions 30*a* of terminals 30.

Figure 6:
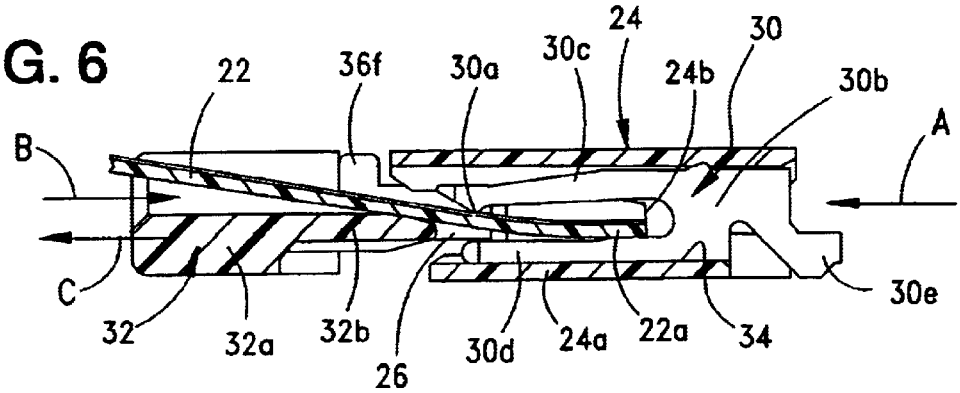
FIG. 6 is an enlarged vertical section taken generally along line 6—6 of FIG. 3, with the actuator in its open position.
Figure 7:
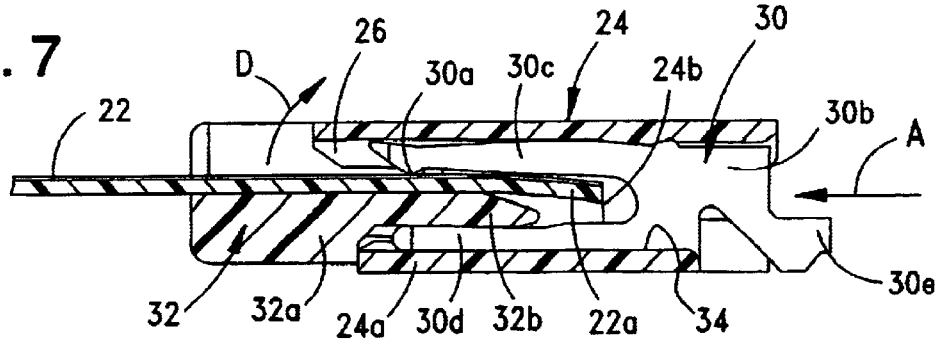
FIG. 7 is a view similar to that of FIG. 6, with the actuator in its closed position.

Referring particularly to FIGS. 6 and 7, each terminal 30 includes a base portion 30*b* from which a contact arm 30*c* projects into mouth 26. The contact arm terminates in contact portion 30*a* at the distal end thereof. A bearing arm 30*d* abuts against a bottom wall 24*a* of housing 24 within a respective terminal-receiving passage 34 for receiving each terminal inserted thereinto in the direction of arrows "A". Each terminal 30 includes a tail portion 30*e* for surface connection, as by soldering, to appropriate circuit traces on a printed circuit board (not shown). FIGS. 6 and 7 also show that housing 24 has an abutment surface 24*b* on the inside thereof, spanning terminal-receiving passages 34, and against which terminating end 22*a* of flat cable 22 abuts to define a fully inserted position of the cable.

Actuator 32 is movably mounted on housing 24 by means of a pair of connecting arms, generally designated 36, as will be described in greater detail hereinafter. The arms allow the actuator to be moved between an open or preload position shown at the right-hand half of FIG. 1 and FIGS. 4 and 6, to a closed or terminating position shown at the left-hand side of FIG. 1 and in FIGS. 5 and 7. The actuator is moved from its open to its closed position in the direction of arrows "B". The actuator is returned from its closed position to its open position in the direction of arrows "C". As best seen in FIGS. 6 and 7, when actuator 32 is moved in the direction of arrow "B" from its open or preload position shown in FIG. 6, to its closed or terminating position shown in FIG. 7, pressing portion 32*b* of the actuator engages the underside of flat flexible cable 22. As the actuator moves to its terminating position shown in FIG. 7, the actuator biases the cable upwardly in the direction of arrow "D" to bias the conductors of the cable against contact portions 30*a* of terminals 30, as contacts arms 30*c* of the terminals are biased upwardly. Bearing arms 30*d* of the terminals, being in rigid abutment with bottom wall 24*a* of the housing, acts as an anvil against which pressing portion 32*b* of the actuator bears.

According to the invention, actuator 30, including body 32*a* and pressing portion 32*b* as well as a pair of arm mounting portions 32*c*, is fabricated of ceramic material of good tenacity such as a zirconia-based, an alumina-based, a silicon nitride-based, a sialon-based or a steatite-based ceramic. Although all of these types of ceramics may be appropriate, the preferred ceramic material is a zirconia-based ceramic. Pulverized zirconia and necessary additives are mixed, and this mixture is molded into the given shape of the actuator as shown in the drawings. The molded actuator is calcinated and sintered. The molded ceramic actuator has good strength, good temperature resistance and is electrically insulating. Because of the strength of the ceramic material, the actuator can have a very thin or low profile without sacrificing any strength.

Figure 8:
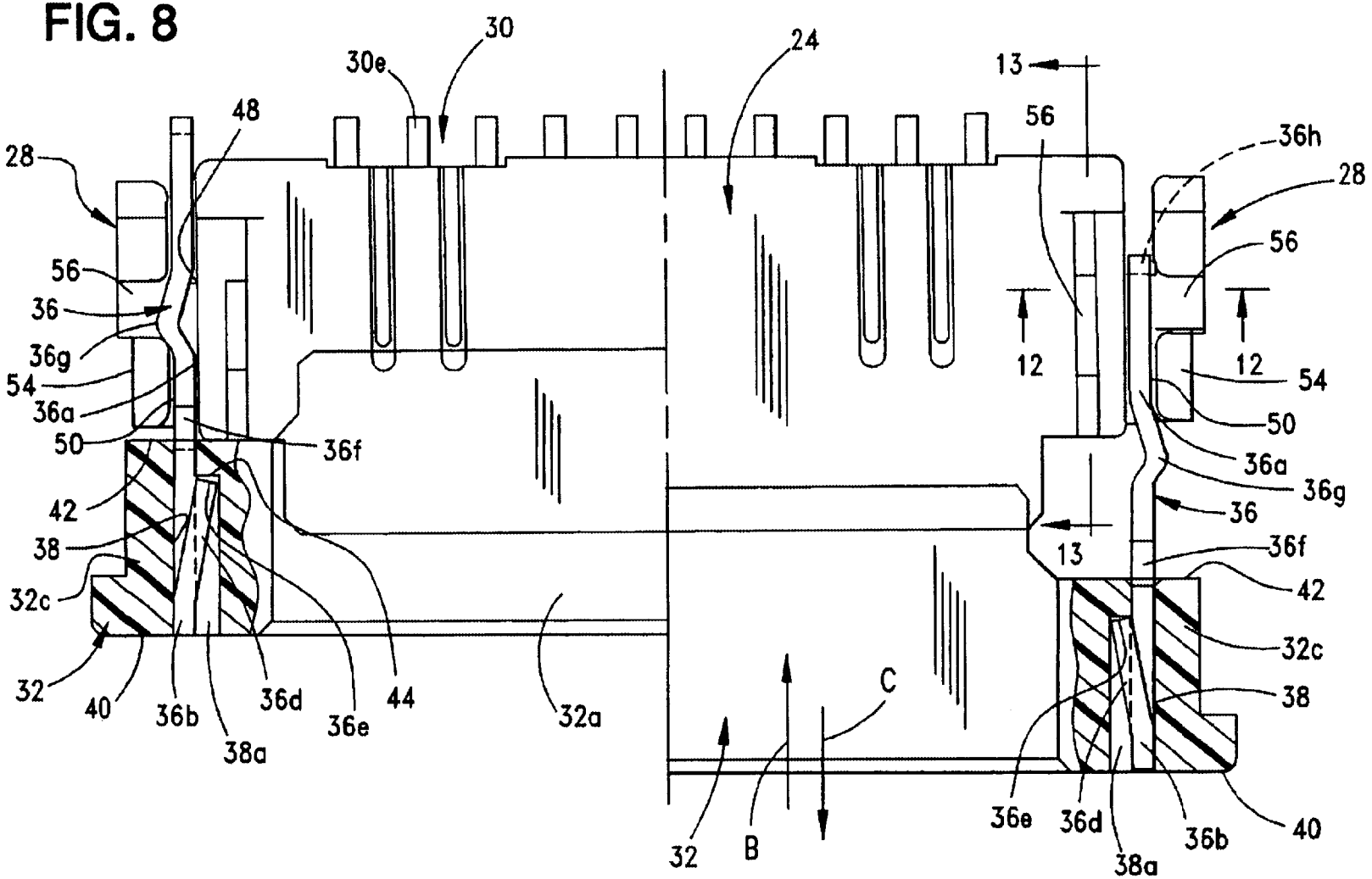
FIG. 8 is an enlarged top plan view, partially in section along line 8—8 of FIG. 3, and with the cover removed to facilitate the illustration.

Actuator 32 is molded to have arm mounting portions 32*c* at opposite ends thereof. Each arm mounting portion has the same exterior shape except that they are directed in opposite directions. Each arm mounting portion includes a through passage 38 as best seen in FIG. 8. Each passage 38 has an offset blind passage portion 38*a*. Through passage 38 extends from a front side 40 of the actuator to a rear side 42 thereof. Offset blind passage portion 38 extends from front side 40 to an abutment surface 44 which defines a dead end of the blind passage portion.

Figure 9:
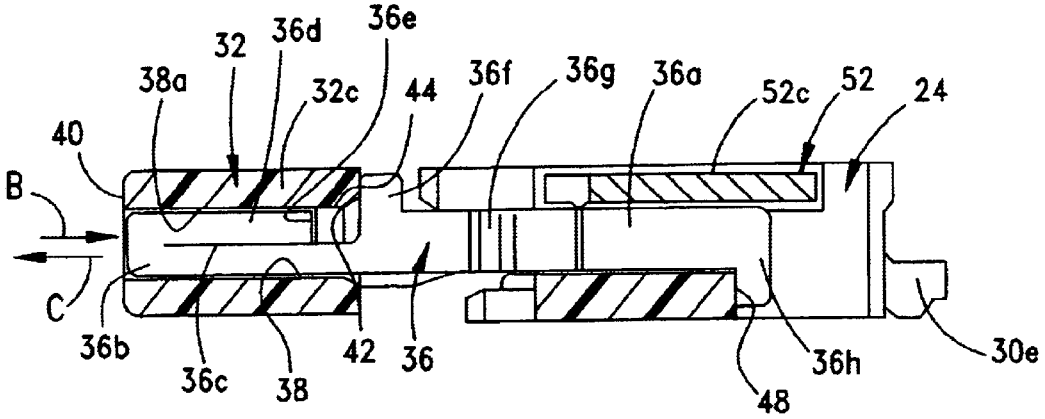
FIG. 9 is an enlarged vertical section taken generally along line 9—9 of FIG. 1.
Figure 10:
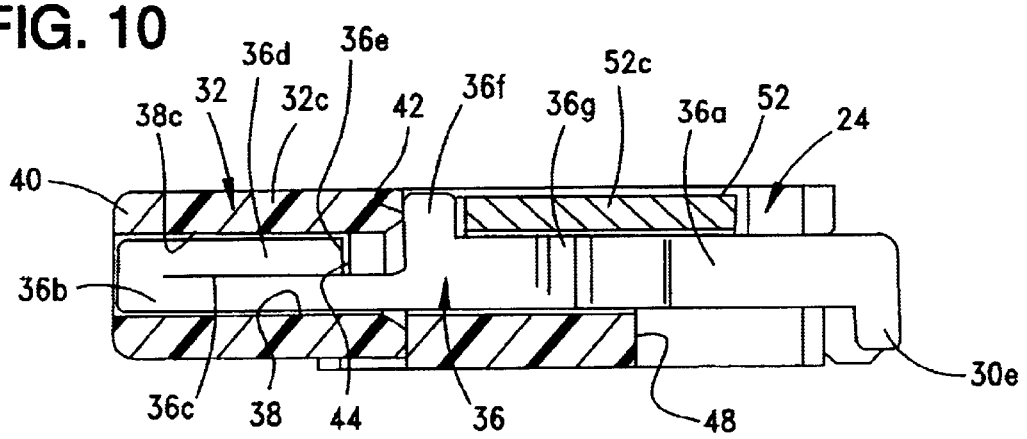
FIG. 10 is a view similar to that of FIG. 9, with the actuator in its closed position.

Referring to FIGS. 9 and 10 in conjunction with FIG. 8, each connecting arm 36 includes an elongated arm portion 36*a* having a resiliently expandable latch head 36*b* at one end thereof. The connecting arm may be stamped and formed of sheet metal material, and resiliently expandable latch head 36*b* is cut or divided along its length, as at 36*c* (FIGS. 9 and 10). A latch finger 36*d* is bent out of the plane of arm portion 36*a*. A distal end of latch finger 36*d* defines a latch hook 36*e* for engaging abutment surface or dead end 44 of offset blind passage portion 38*a* of the respective through passage 38. An upwardly projecting stop boss 36*f* is engageable with rear side 42 of the respective arm mounting portion 32*c* to limit the extent to which resiliently expandable latch head 36*b* can be inserted into through passage 38. As best seen in FIG. 8, the arm portion 36*a* of each connecting arm 36 has a V-shaped bent latch 36*g* intermediate opposite ends of the latch arm. As best seen in FIGS. 9 and 10, each connecting arm 36 has a downwardly projecting stop boss 36*h* for engaging a stop shoulder 48 of housing 24 to prevent the latch arms and actuator 32 from being pulled completely away from the housing.

Figure 12:
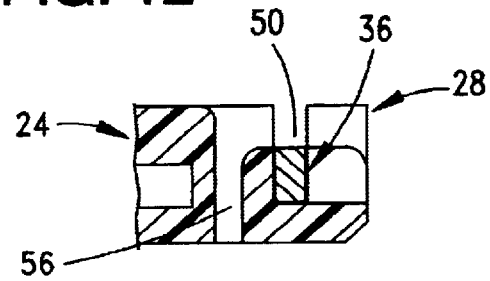
FIG. 12 is a fragmented vertical section taken generally along line 12—12 of FIG. 8.
Figure 13:
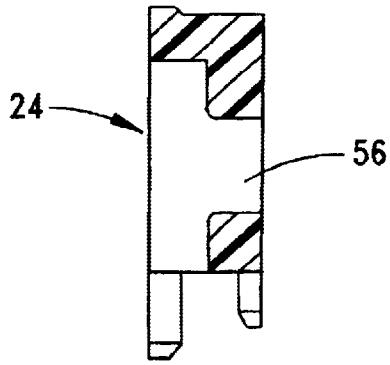
FIG. 13 is a vertical section taken generally along line 13—13 of FIG. 8.

Referring to FIG. 12 in conjunction with FIG. 8, each arm holder 28 at opposite sides or ends of housing 24 includes an arm-receiving slot or channel 50 as will be described in greater detail hereinafter. A cover, generally designated 52 (FIG. 1), covers the connecting arm and holds the arm in the slot. Each arm holder 28 has an outer wall 54 with a latch opening 56 therein.

Figure 14:
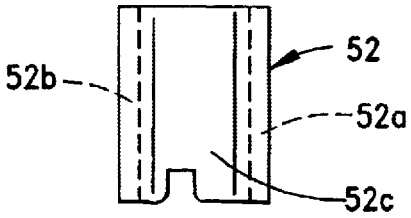
FIG. 14 is a top plan view of one of the covers.
Figure 15:
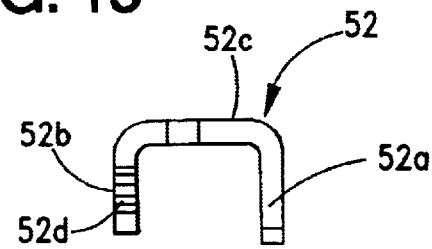
FIG. 15 is a front elevational view of the cover.
Figure 16:
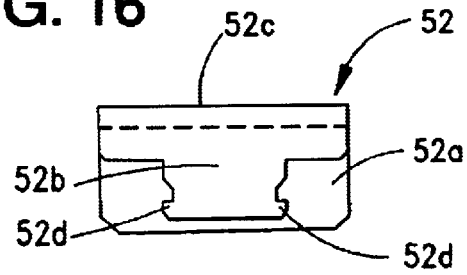
FIG. 16 is a side elevational view of the cover.
Figure 17:
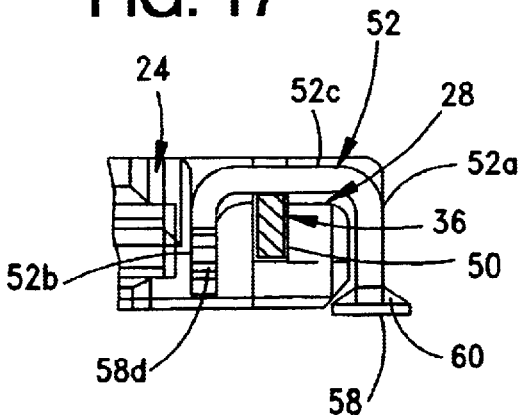
FIG. 17 is a front elevational view of the area of the dielectric housing to which the cover is applied.
Figure 18:
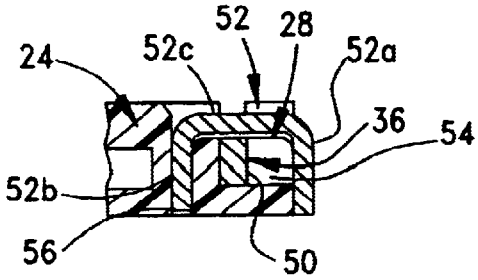
FIG. 18 is an enlarged, fragmented vertical section taken generally along line 18—18 of FIG. 1.

Referring to FIGS. 14–16, each cover 52 is generally U-shaped and includes an outer leg 52*a* and an inner leg 52*b* joined by a top crown portion 52*c*. Inner leg 52*b* has outwardly projecting teeth 52*d*. As best seen in FIGS. 8 and 12, a cover slot 56 is formed in housing 24 spaced inwardly from each arm slot or channel 50. Each cover is assembled to the housing as best seen in FIG. 18 with connecting arm 36 disposed beneath the cover within arm slot 50. The cover is mounted by positioning outer leg 52*a* outside outer wall 54 of the housing and positioning inner leg 52*b* into cover slot 56 as is clearly seen in FIG. 18. Teeth 52*d* (FIGS. 16) of the cover bite into the plastic material at the sides of cover slot 56. The cover is effective to hold the respective connecting arm in arm slot 50 of the housing. After the covers are fully assembled, the cover members are fixed to a printed circuit board 58 as seen in FIG. 17 by a solder connection 60.

Figure 11:
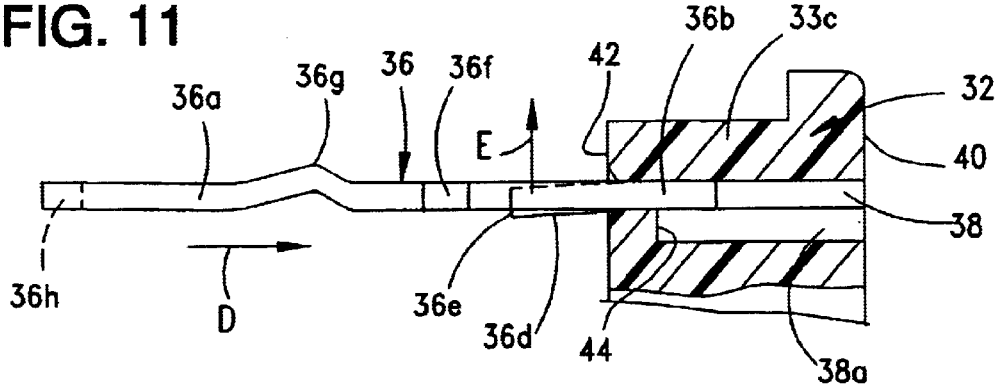
FIG. 11 is a horizontal section through one of the passages of the actuator with the respective connecting arm about to be inserted thereinto.

In assembly, and referring to FIG. 11, each connecting arm 36 is inserted into a respective one of the arm mounting options 32*c* of actuator 32 in the direction of arrow "D". In essence, resiliently expandable latch head 36*b* of the connecting arm is inserted into through passage 38. When so inserted, latch finger 36*d* is biased inwardly toward latch arm portion 36*a* in the direction of arrow "E" so that the latch finger can pass into through passage 38. The connecting arm is pushed into the through passage until latch hook 36*e* at the distal end of latch finger 36*d* passes abutment surface or dead end 44 of offset blind passage portion 38*a*. At that point, latch finger 36*d* snaps back outwardly into engagement with abutment surface 44 as shown in FIG. 8. Stop boss 36*f* abuts against rear side 42 of the arm mounting portion, and the connecting arm is fixed to the actuator because latch hook 36*e* and stop boss 36*f* prevent the connecting arm from moving in either of its longitudinal directions.

With metal connecting arms 36 mounted to ceramic actuator 32 as described above, the connecting arms can then be positioned downwardly into arm slots 50 of housing 24 so that stop bosses 36*h* are positioned behind stop shoulders 48 as shown in FIG. 9. Covers 52 then are positioned as described above, onto the tops of the connecting arms, and the covers can be soldered to the printed circuit board as described above in relation to FIG. 17. Actuator 32 and connecting arms 36 now are movably fixed to connector housing 24 for movement between the open or preload position of the actuator shown at the right-hand sides of FIGS. 1 and 8 as well as FIGS. 6 and 9, to the closed or terminating position of the actuator described above and shown at the left-hand sides of FIGS. 1 and 8 as well as FIGS. 7 and 10. When the actuator is moved in the direction of arrows "B" to the closed or terminating position, V-shaped bent latches 36*g* are flattened out until the latches become aligned with latch openings 56 in outer walls 54 of arm holders 28. The V-shaped bent latches 36*g* will snap outwardly into latch openings 36 to hold the actuator in its closed or terminating position. The actuator can be pulled back outwardly in the direction of arrows "C", whereupon bent latches 36*g* move out of latch openings 56 until the actuator reaches its open or preload position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for terminating a flat flexible cable, comprising:

a dielectric housing having an elongated mouth for receiving a terminating end of the flat flexible cable, the housing having arm holders generally at opposite ends of the mouth;

a plurality of conductive terminals mounted on the housing and spaced along the mouth, the terminals having contact portions for electrically engaging appropriate conductors of flexible cable;

an elongated actuator movably mounted on the housing and including a body with a pressing portion for biasing the cable against the contact portions of the terminals, the actuator being fabricated of rigid ceramic material, and including a passage;

a pair of connecting arms at opposite ends of the actuator and of a resilient material other than ceramic each connecting arm having a first end for insertion into the arm holders of the housing and a second end for insertion into the passage of the actuator; and complementary interengaging latch means between the connector and the actuator within the passage to hold the arm therein.

2. The electrical connector of claim 1 wherein said actuator is fabricated of a zirconia ceramic material.

3. The electrical connector of claim 1 wherein said connecting arms are fabricated of metal material.

4. The electrical connector of claim 3 wherein said actuator is fabricated of a zirconia ceramic material.

5. The electrical connector of claim 1 wherein each connecting arm includes a resilient latch head engageable with a latch surface on the actuator in the respective passage.

6. The electrical connector of claim 5 wherein said resilient latch head snaps into engagement with said latch surface automatically in response to insertion into the respective passage whereby the respective connecting arm cannot be pulled back out of the passage.

7. The electrical connector of claim 6, including complementary interengaging stop means between each connecting arm and the actuator to limit the extent to which the connecting arm can be inserted into the passage.

8. The electrical connector of claim 1 wherein each arm holder on the dielectric housing includes a channel for receiving a respective one of the connecting arms, and a cover mountable on the housing to hold the respective connecting arm in its channel.

9. An electrical connector for terminating a flat flexible cable, comprising:

a dielectric housing having an elongated mouth for receiving a terminating end of the flat flexible cable, the housing having arm holders generally at opposite ends of the mouth;

a plurality of conductive terminals mounted on the housing and spaced along the mouth, the terminals having contact portions for electrically engaging appropriate conductors of flexible cable;

an elongated actuator movably mounted on the housing and including a body with a pressing portion for biasing the cable against the contact portions of the terminals, the actuator being fabricated of rigid zirconia ceramic material, and the actuator including passages at opposite ends thereof;

a pair of resilient metal connecting arms mounted in the passages at opposite ends of the actuator for insertion into the arm holders of the housing; and complementary interengaging latch means between the connecting arms and the actuator within said passages to hold the arms therein.

10. The electrical connector of claim 9 wherein each connecting arm includes a resilient latch head engageable with a latch surface on the actuator in the respective passage.

11. The electrical connector of claim 10 wherein said resilient latch head snaps into engagement with said latch surface automatically in response to insertion into the respective passage whereby the respective connecting arm cannot be pulled back out of the passage.

12. The electrical connector of claim 11, including complementary interengaging stop means between each connecting arm and the actuator to limit the extent to which the connecting arm can be inserted into the passage.

13. The electrical connector of claim 9 wherein each arm holder on the dielectric housing includes a channel for receiving a respective one of the connecting arms, and a cover mountable on the housing to hold the respective connecting arm in its channel.

* * * * *